US007404410B2

(12) United States Patent
Pardini

(10) Patent No.: US 7,404,410 B2
(45) Date of Patent: Jul. 29, 2008

(54) DISH-WASHING MACHINE WITH VERSATILITY OF POSITION

(75) Inventor: Gianluca Pardini, Lucca (IT)

(73) Assignee: Premark FEG L.L.C., Wilmington, DE (US)

( * ) Notice: Subject to any disclaimer, the term of this patent is extended or adjusted under 35 U.S.C. 154(b) by 506 days.

(21) Appl. No.: 10/963,911

(22) Filed: Oct. 13, 2004

(65) Prior Publication Data

US 2005/0081896 A1 Apr. 21, 2005

(30) Foreign Application Priority Data

Oct. 17, 2003 (IT) ..... BO2003A0610

(51) Int. Cl.
*B08B 3/00* (2006.01)

(52) U.S. Cl. ..... 134/144; 134/133; 134/137; 134/56 D; 134/57 D; 134/58 D

(58) Field of Classification Search ..... 134/56 D, 134/57 D, 58 D, 133, 137, 144
See application file for complete search history.

(56) References Cited

U.S. PATENT DOCUMENTS

| | | | | |
|---|---|---|---|---|
| 2,073,521 | A | 3/1937 | Johnston et al. | |
| 2,974,672 | A | 3/1961 | Fox | |
| 5,927,616 | A * | 7/1999 | Grise et al. | 239/600 |
| 6,955,179 | B2 * | 10/2005 | Ecker et al. | 134/134 |

FOREIGN PATENT DOCUMENTS

| | | | |
|---|---|---|---|
| DE | 3235007 | A1 | 3/1984 |
| DE | 0917277 | * | 5/1999 |
| EP | 0917277 | A | 5/1999 |

* cited by examiner

*Primary Examiner*—Michael Barr
*Assistant Examiner*—Jason Heckert
(74) *Attorney, Agent, or Firm*—Thompson Hine LLP

(57) ABSTRACT

Described herein is a dish-washing machine, in which there is provided: at least one supporting structure; a washing station, defined by one or more washing arms; a rinsing station, defined by one or more rinsing arms and by at least two attachment assemblies for attachment of the rinsing arms, which are positioned on opposite sides of the washing arms; and reversible movement means for displacing a dish rack from the washing station to the rinsing station.

12 Claims, 3 Drawing Sheets

DISH-WASHING MACHINE WITH VERSATILITY OF POSITION

The present invention relates to a dish-washing machine with versatility of position.

BACKGROUND OF THE INVENTION

Normally, dish-washing machines used in establishments such as hotels and restaurants comprise at least one loading station, a washing station, a rinsing station, and an unloading station. The sequence of these stations and of their components is fixed and is established when the machine itself is made.

Such a constraint results in a limitation in the positioning the dish-washing machine. In fact, the dish-washing machines described above can be set only in certain positions, thus affecting the disposition of the premises that house them.

SUMMARY OF THE INVENTION

The purpose of the present invention is to provide a dish-washing machine the technical characteristics of which will enable the drawbacks of the known art to be overcome in a simple and economically advantageous way.

The subject of the present invention is a dish-washing machine comprising: at least one washing station, defined by one or more washing arms; a rinsing station, defined by one or more rinsing arms; and movement means, designed to displace a dish rack at least from the washing station to the rinsing station; said dish-washing machine being characterized in that it comprises attachment means for said rinsing arms positioned on both sides of said washing station, and in that said movement means are reversible.

The dish-washing machine of the present invention affords the considerable advantage of reversing the direction in which the dish rack moves by displacing just the rinsing station with respect to the washing station, i.e., without modifying the position of the washing arms. In this way, it will be possible to set the dish-washing machine in the most convenient position for loading and unloading.

BRIEF DESCRIPTION OF THE DRAWINGS

The example presented in what follows has a purely illustrative and non-limiting purpose, in order to enable a better understanding of the invention, with the aid of the annexed table of drawings, in which.

DETAILED DESCRIPTION OF THE INVENTION

Figure 1:
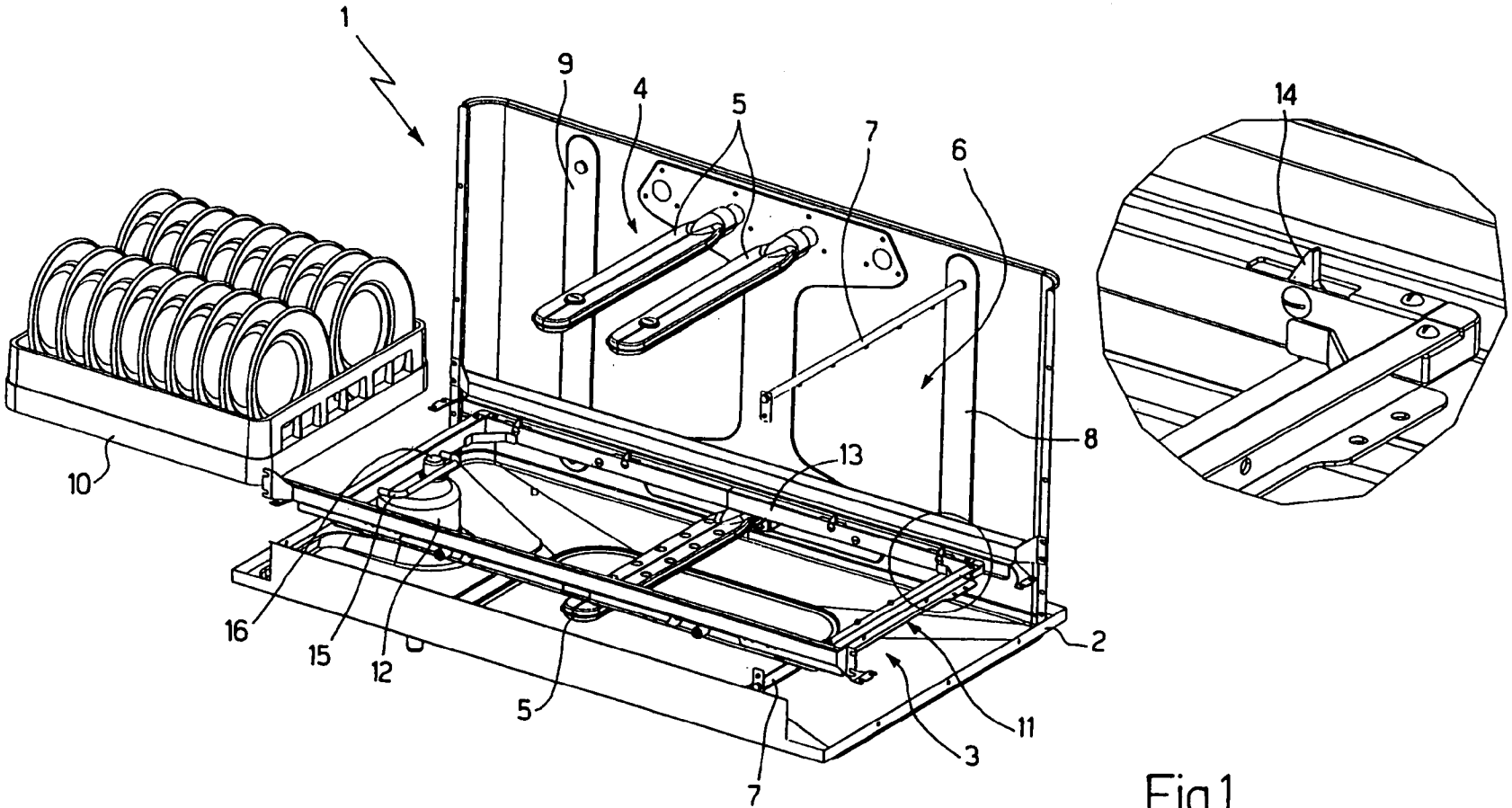
FIG. 1 is a perspective view of a dish-washing machine, with parts removed, according to a preferred embodiment of the present invention.
Figure 3:
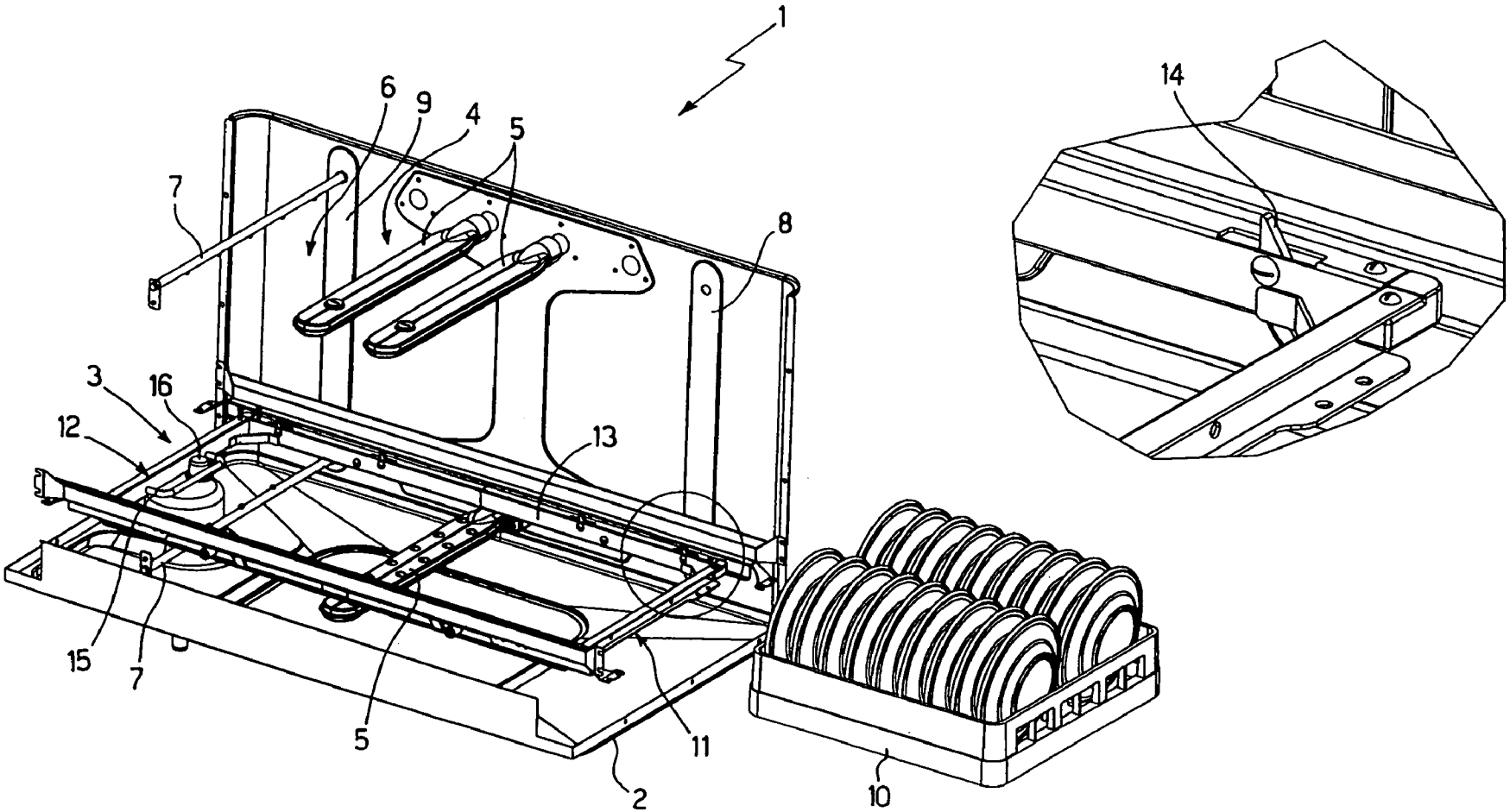
FIG. 3 is a perspective view of the dish-washing machine of FIG. 1 in a further configuration of operation thereof.

In FIGS. 1 and 3, designated as a whole by 1 is a dish-washing machine. The dish-washing machine 1 comprises: a supporting structure 2 for supporting the movement means 3; a washing station 4, defined by three washing arms 5, from which a water/detergent mixture is delivered; and a rinsing station 6, defined by two rinsing arms 7, from which the rinsing water is delivered.

The dish-washing machine 1 further comprises a first attachment assembly 8 and a second attachment assembly 9 for attachment of the rinsing arms 7. The two assemblies 8 and 9 are arranged on opposite sides with respect to the washing station 4. In this way, it is possible to fix, as desired, the position of the rinsing station 6 with respect to the washing station 4.

Since the assemblies 8 and 9 are known to a person skilled in the art, they will not be described hereinafter.

The movement means 3 have the function of displacing a dish rack 10 from the washing station 4 to the rinsing station 6, and comprise a thrust carriage 11 and an actuation assembly 12, designed to move the carriage 11 according to a reciprocating translational motion.

The thrust carriage 11 comprises a rectangular frame 13, a plurality of engagement teeth 14, hinged on two long sides 13*a* of the frame 13, and a handle element 15.

The actuation assembly 12 comprises a pin 16, which engages the handle element 15 and moves along a circular path and is moved by an appropriate electric motor (known and not illustrated herein). As is known, the engagement of the pin 16 with the handle element 15 enables conversion of the circular motion of the pin 16 itself into the reciprocating translational motion of the thrust carriage 11.

As is known, the engagement teeth 14 are hinged to the frame 13 in such a way that, only when the thrust carriage 11 is displaced in one direction, they remain in a vertical position so that they can exert the action of thrust on the rack 10.

Figure 2:
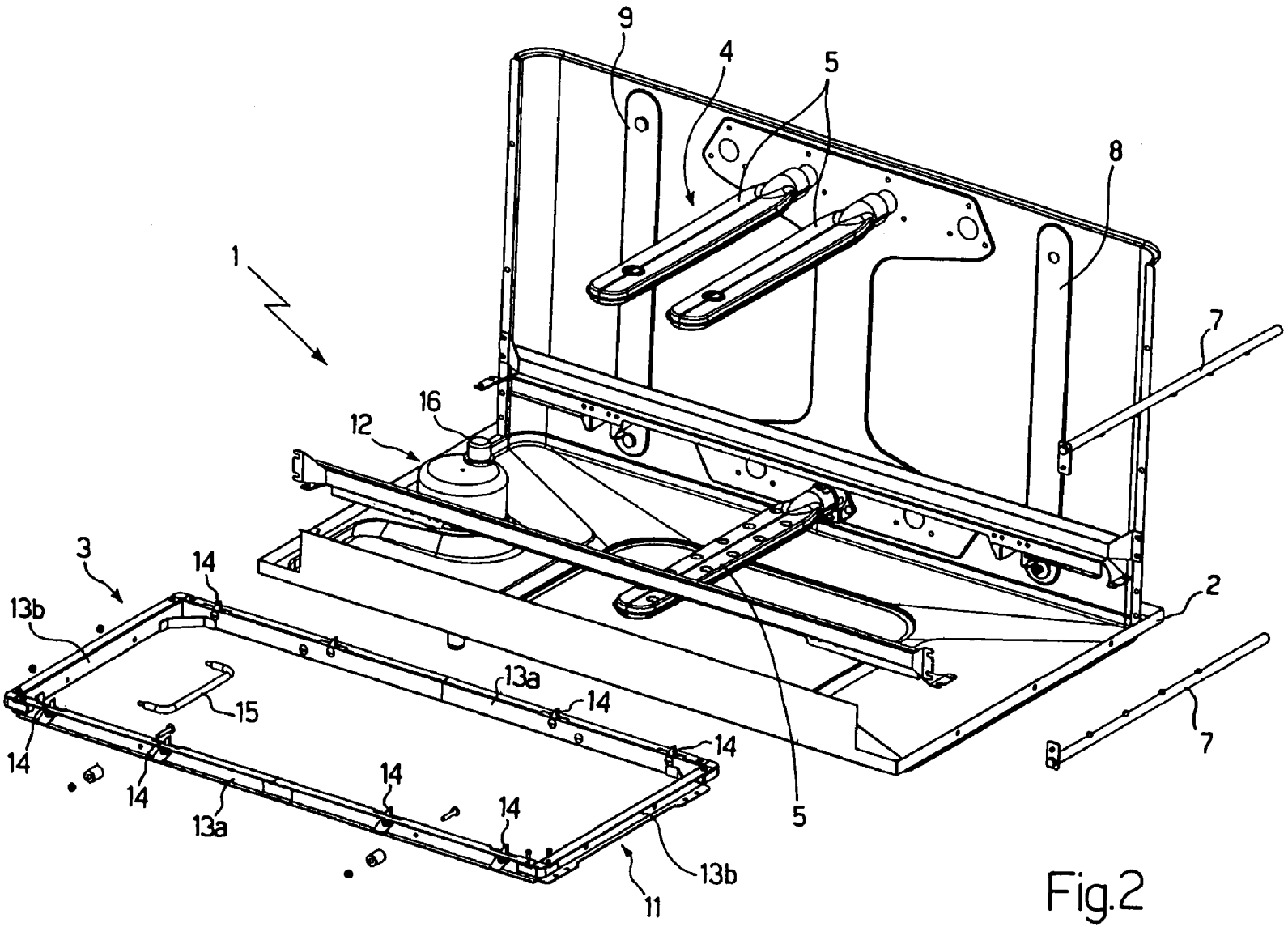
FIG. 2 is an exploded view of the portion of the dish-washing machine of FIG. 1.

As illustrated in FIG. 2, the handle element 15 can be fixed in a removable way indifferently to one or other of the two short sides 13*b* of the frame 13. In this way, it will be possible to set the correct direction of advance of the rack 10 according to where the rinsing station 6 has been positioned with respect to the washing station 4.

In fact, as may be noted from the comparison of FIGS. 1 and 3, the dish-washing machine of the present invention can set the rinsing station in two different positions with respect to the washing station, which remains fixed. From a comparison of the enlarged details of FIGS. 1 and 3, it may be noted how, by replacing the short side 13*b*, on which the handle element 15 is fixed, and rotating the frame 13 through 180°, it is possible to set the engagement teeth 14 in the correct direction.

In use, to pass from the position of the rinsing station illustrated in FIG. 1 to the position of the rinsing station illustrated in FIG. 3, it will be necessary to dismantle the rinsing arms 7 from the attachment assembly 8 to re-install them on the assembly 9. At this point, it will be sufficient to rotate the frame 13 of the movement means 3 through 180°, having removed the handle element 15 from one of the two short sides 13*b*, where it was fixed, to re-install it on the opposite short side 13*b*.

As will emerge clearly from the foregoing description, the dish-washing machine of the present invention enables freedom of displacement of the rinsing station, and hence the loading station, according to the disposition of the premises in which the dish-washing machine itself is to be set.

The invention claimed is:

1. A dish-washing machine comprising:

at least one supporting structure;

a washing station, defined by one or more washing arms;

a rinsing station positioned to a first side of the washing arms, the rinsing station defined by one or more rinsing arms, the rinsing arms are connected to a first attachment assembly located to the first side of the washing arms;

movement means, configured to displace dish racks in a first direction at least from the washing station to the rinsing station;

said dish-washing machine being characterized in that it is readily convertible to reposition the rinsing station to a second side of the washing arms, the second side opposite the first side, in that said dish-washing machine includes:

a second attachment assembly configured for attachment of said one or more rinsing arms, said second attachment assembly positioned on the second side of said washing arms such that removal of said one or more rinsing arms from the first attachment assembly and connection of said one or more rinse arms to the second attachment assembly relocates the rinsing station from the first side of the washing arms to the second side of the washing arms, and said movement means are reconfigurable to displace dish racks in a second direction, which is opposite the first direction, through the dish-washing machine.

2. The dish-washing machine according to claim 1, wherein said movement means comprise a thrust carriage orientable according to the direction of the thrust that it is desired to exert on said dish rack, and an actuation assembly for actuation of said thrust means.

3. The dish-washing machine according to claim 2, wherein said actuation assembly is fixedly set on said supporting structure.

4. The dish-washing machine according to claim 3, wherein said thrust carriage comprises a removable element, which is engaged by said actuation assembly and the position of which determines the direction of the action of thrust.

5. The dish-washing machine according to claim 4, wherein said thrust carriage comprises a frame, a plurality of engagement teeth, hinged to said frame, and in that said removable element is a handle element, designed to be fixed in a removable way alternatively on at least two opposite sides of said frame.

6. The dish-washing machine according to claim 5, wherein said engagement teeth are hinged on the two long sides of said frame, and in that said handle element can be fixed on either one of two short sides of said frame.

7. A dish-washing machine, comprising:

at least one supporting structure;

a dish rack movement mechanism positioned to move dish racks along a path and selectively configurable to move dish racks in either a first direction along the path or a second direction along the path opposite the first direction;

a washing station located along the path and including at least one washing arm;

a first rinse arm attachment assembly positioned to a first side of the washing station along the path;

a second rinse arm attachment assembly positioned to a second side of the washing station opposite the first side along the path;

at least one rinse arm selectively connectable to either the first rinse arm attachment assembly or the second rinse arm attachment assembly to permit selective positioning of a rinsing station to only the first side or only the second side of the washing station.

8. The dish-washing machine of claim 7 wherein the dish rack movement mechanism includes an elongated frame with engagement teeth on the two long sides of the frame, the frame moved in a reciprocating manner, the frame positionable in either a first orientation with a first short side toward a first end of the dish-washing machine or a second orientation with the first short side toward a second end of the dish-washing machine.

9. The dish-washing machine of claim 8 wherein the dish rack movement mechanism includes a handle removably connectable at either the first short side of the frame or at a second short side of the frame, the machine includes an actuator at the first end of the machine for engaging the handle to move the elongated frame.

10. A dish-washing machine, comprising:

at least one supporting structure;

a dish rack movement mechanism positioned to move dish racks along a path and selectively configurable to move dish racks in either a first direction along the path or a second direction along the path opposite the first direction;

a washing station located along the path and including at least one washing arm, the washing station located to wash dishes carried by dish racks regardless of whether the dish racks are moved in the first direction along the path or the second direction along the path;

a first rinse arm attachment assembly positioned to a first side of the washing station along the path;

a second rinse arm attachment assembly positioned to a second side of the washing station opposite the first side along the path; and a rinse arm selectively connectable to either the first rinse arm attachment assembly when dish racks are moved in the first direction or the second rinse arm attachment assembly when dish racks are moved in the second direction to permit selective positioning of a rinsing station to only the first side or only the second side of the washing station depending on the direction dish racks are moving along the path so that the dish racks move into the rinsing station after moving through the washing station regardless of whether dish racks are moved in the first direction along the path or the second direction along the path.

11. The dish-washing machine of claim 7 wherein the dish rack movement mechanism includes an elongated frame with engagement teeth on the two long sides of the frame, the frame moved in a reciprocating manner, the frame positionable in either a first orientation with a first short side toward a first end of the dish-washing machine or a second orientation with the first short side toward a second end of the dish-washing machine.

12. The dish-washing machine of claim 8 wherein the dish rack movement mechanism includes a handle removably connectable at either the first short side of the frame or at a second short side of the frame, the machine includes an actuator at the first end of the machine for engaging the handle to move the elongated frame.

* * * * *